US007111575B2

(12) United States Patent
McGinnis

(10) Patent No.: US 7,111,575 B2
(45) Date of Patent: Sep. 26, 2006

(54) SYNTHETIC FUEL PLANT

(76) Inventor: Charles Douglas McGinnis, 45 Golf Dunes La., Santa Rosa Beach, FL (US) 32459

( * ) Notice: Subject to any disclaimer, the term of this patent is extended or adjusted under 35 U.S.C. 154(b) by 434 days.

(21) Appl. No.: 10/424,667

(22) Filed: Apr. 28, 2003

(65) Prior Publication Data

US 2004/0211348 A1 Oct. 28, 2004

(51) Int. Cl.
*B63B 35/44* (2006.01)

(52) U.S. Cl. ..... 114/264; 405/195.1; 44/620

(58) Field of Classification Search ..... 114/26, 114/73, 74 A, 264; 405/207, 195.1; 414/140.9; 44/530, 553, 564, 568, 620, 626, 628
See application file for complete search history.

(56) References Cited

U.S. PATENT DOCUMENTS

| | | | | | |
|---|---|---|---|---|---|
| 2,021,629 | A | * | 11/1935 | Leigh | 114/26 |
| 2,834,660 | A | * | 5/1958 | Franz | 44/568 |
| 3,403,989 | A | * | 10/1968 | Blake et al. | 44/564 |
| 4,152,119 | A | * | 5/1979 | Schulz | 44/530 |
| 4,234,320 | A | * | 11/1980 | Verschuur | 44/551 |
| 4,359,958 | A | * | 11/1982 | Durant et al. | 114/74 A |
| 4,515,601 | A | * | 5/1985 | Charters | 44/530 |
| 4,526,121 | A | * | 7/1985 | Shudo et al. | 114/73 |

* cited by examiner

*Primary Examiner*—Lars A. Olson
(74) *Attorney, Agent, or Firm*—Wood, Herron & Evans, LLP

(57) ABSTRACT

A self-contained, floating, waterway supplied and moveable synthetic fuel plant includes apparatus for receiving components of and for making synthetic fuel of coal and binder for energy consumers. Processes are disclosed.

15 Claims, 2 Drawing Sheets

SYNTHETIC FUEL PLANT

FIELD OF THE INVENTION

This invention relates to the manufacture of synthetic fuel and more particularly to the manufacture of synthetic fuel (sometimes referred to as "synfuel") preferably comprising mined coal and an approved liquid binder in an improved synthetic fuel manufacturing plant.

BACKGROUND OF THE INVENTION

Use of synthetic fuel comprising coal treated with liquid binder is known. There are a number of approved binders suitable for use in synfuel plants, the most popular being latex-based. Typically, mined coal is sprayed with a binder compound or mixture, optionally formed into briquets or pellets, and then delivered to the furnace of a synthetic fuel consumer such as an energy producer. Such synthetic fuel treatment plants are made, for example, by Startec, Inc. of Dublin, Ohio. Significant tax credits are available for synthetic fuel producers under strict IRS guidelines, as the product is typically more energy efficient in BTUs produced or the like.

Current plants producing such synthetic fuels, however, are attended by many significant problems. For example, a plant is typically erected on or near an energy producing site on land in a fixed location. Mined coal is delivered to the plants most typically in one or two ways: plants sited along a navigable waterway receive most of if not all shipments by barge; those in landlocked locations receive most if not all shipments by rail. In both cases, the coal is unloaded at a storage site onto ground. The liquid binder product is most typically delivered by over-the road tanker trucks. The coal must then be moved over the ground to load the processing equipment of the sunfuel plant. This process entails heavy equipment and conveyor systems which pose both air and land environmental concerns. Multiple handling equipment is necessary to move the coal from the storage site to the synfuel facility and then to the boilers, ovens or furnaces of the energy producer. Finally, because the synfuel facility is typically erected on or proximate the facility of the energy plant and dedicated to that site, it must meet all the cerfification and other regulatory requirements of the governmental body such as a state and/or municipality having jurisdiction over the location.

There are about 25,000 miles of commercially navigable inland waterways in the United States and it is desirable to provide improved structures and means for supplying synfuel to energy producers situated alongside them. Accordingly, it has been objective of the invention to provide an improved process and apparatus for manufacturing synthetic fuel for use at these sites.

It has been another objective of the invention to provide an improved process and apparatus for manufacturing synthetic fuel.

Another objective of the invention has been to provide improved process and apparatus for making synthetic fuel autonomously from an energy plant in which the fuel will be used.

Another objective of the invention has been to provide improved process and apparatus for making synthetic fuel while avoiding the need for regulatory compliance with the governing bodies having jurisdiction over the energy plant where the synthetic fuel will be used.

Another objective of the invention has been to eliminate ground and surface water contamination by coal delivered to the processing plant.

Another objective of the invention has been to eliminate the overland delivery of coal and liquid binder to a synthetic fuel manufacturing plant.

Another objective of the invention has been to provide an improved synthetic fuel processing plant not fixed or dedicated to the energy facility in which the fuel will be used.

Another objective of the invention is to eliminate the need for construction of land-based foundation structures and the demolition/restoration of the site once the synfuel plant has completed its commitment.

Another objective of the invention is to eliminate the need to dismantle the synfuel plant and move it overland on multiple flatbed trucks to a new location.

SUMMARY OF THE INVENTION

To these ends, the invention contemplates a self-contained, floating, synthetic fuel plant to which mined coal and liquid binder are preferably barge delivered, and from which synthetic fuel is delivered to one or more energy plants, preferably by barge.

As used herein, the term "mined coal" refers to coal pieces of such size that at least 50% by weight pass through a ⅜ inch screen. Thus, "mined coal" means coal which has been mined and crushed or broken up to this specification.

As used herein, "liquid binder" means any suitable or approved form of liquid binder capable of being combined with coal to produce synthetic fuel. There are a number of approved binders suitable for use in synfuel plants. The most popular is latex-based. Others include top oil/pine tar-based products, molasses-based and even asphalt-based. In the case of latex products, most in the market are blended by Dow Chemical Company at one of its latex manufacturing facilities under tolling agreements with various binder providers, each using their own proprietary additives. The particular binder used does not comprise any feature of this invention.

Providing a synthetic fuel processing plant on a barge or other floating base provides significant advantages over typical land-based plants. For example, coal and liquid binder such as latex are delivered to the plant by barge, and in large quantities. Processed synthetic fuel is also delivered from the plant to an energy producing site by barge. Transportation costs are low. There is no overland delivery of raw products and no resulting ground or surface water contamination.

The synthetic fuel plant according to the invention is positioned in a river or in a selected position in the 25,000 miles of commercially navigable inland waterways in the United States, for example. There it is separate from and, in many instances, not located in the same jurisdiction as the energy producer it serves. For example, a self-contained, floating synthetic fuel plant according to the invention may serve an energy facility on the Ohio banks of the Ohio River, but many not be subject to Ohio regulatory laws, but rather to the owner of the river, i.e. Kentucky. Thus, in some instances, then problems with obtaining building permits, for example, in Ohio, are eliminated.

Moreover, if an energy producer or facility fails, is closed, moves, or switches to an alternate fuel, the synthetic fuel plant according to the invention can easily be moved to serve another energy producer. Also, a single synthetic fuel plant, according to the invention, can serve more than one energy facility from one location by barge.

Accordingly, advantages provided by the invention include, but are not limited to: facilitation of EPA compliance; labor compliance; elimination of overland transportation of product; mobility; reduction or elimination of governmental permit and regulation jurisdictional problems facilitates delivery of raw products of coal and liquid binder to the synthetic fuel plant in large quantities and by cheaper transportation than overland delivery and elimination of ground and surface water contamination by dumping of coal on the ground of the synthetic fuel plant.

In an alternate embodiment, a self-contained, floating synthetic fuel plant according to the invention may be provided with any suitable form of conveyor or other transfer apparatus than barges for receiving coal, liquid binder or both from land, or for delivering synthetic fuel to an energy facility on land.

These and other advantages and alternatives will become readily appreciated from the following detailed description and drawings in which:

DETAILED DESCRIPTION OF A PREFERRED EMBODIMENT OF THE INVENTION

Figure 1:
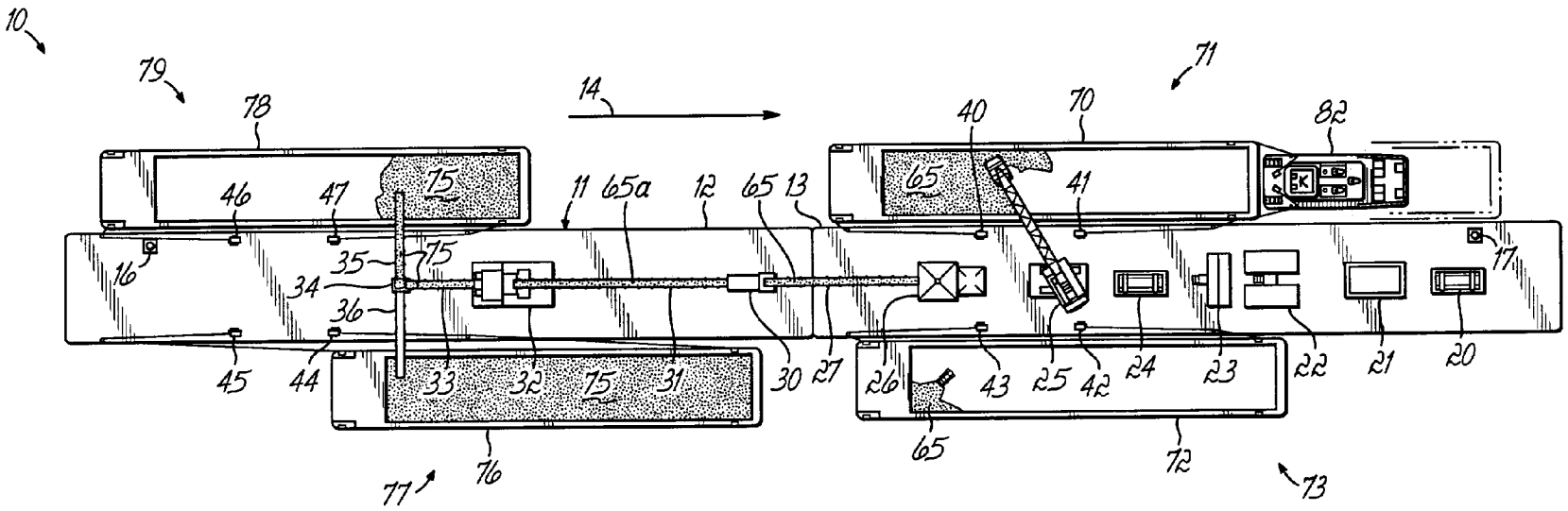
FIG. 1 is a plan view illustrating features of a floating, synthetic fuel plant according to the invention.

For purposes of the following descriptions, the terms "mined coal" and "liquid binder" have the meanings as described above.

Turning now to the figures, there is shown an improved synthetic fuel plant 10 according to the invention.

Plant 10 includes an elongated floating barge 11, comprised of one or more floating barge sections, two sections being shown at 12 and 13, and each, for example, about 295 feet long. Barge 11 is free floating above waterway bottom "B" (FIG. 2), i.e. not permanently supported by pilings or such structures. Barge 111 may be tethered in place in a river or commercially navigable inland waterway, the flow 14 of which is indicated by the arrows in FIGS. 1 and 2. Such tethering may be by way of one or more anchors 15 (FIG. 2) on bottom "B" or by slidable tethers to pilings 16, 17, for example, extending up from bottom "B". Barge 11 can rise and fall with the water level 18 (FIG. 2).

Disposed on section 13 of barge 11 are, from right to left (FIG. 1), a diesel fuel tank 20, a maintenance and generator shed or housing 21, crew quarters 22, 23, liquid binder tank 24, a crane 25 for unloading mined coal from a delivery barge, a hopper assembly 26, and a conveyor 27 for receiving mined coal from crane 25 and hopper assembly 26 and conveying it forwardly.

Disposed on section 12, from right to left (FIG. 1) are conveyor 27, liquid binder applicator 30, conveyor 31 for receiving mined coal treated with liquid binder and conveying such treated coal to a briquetting unit 32. A conveyor 33 receives briquetted synthetic fuel, or other forms of synthetic fuel from briquetting unit 32 and conveys it to a diverter 34, where the synthetic fuel is directed to discharge conveyors 35 or 36 (or both) for delivery to one or more respective synthetic fuel delivery barges, as will be described.

Binder applicator 30 is of any suitable type. Generally, the applicator comprises a plurality of nozzles oriented to spray binder onto free falling mined coal, or coal pieces, to coat them. Any suitable binder applicator can be used within the scope of the invention.

Briquetting unit 32 is of any suitable type, such as any of those made by Komar Industries of Groveport, Ohio, under Model Designation KB2736; or by the Fleming Eagle Casting Machine Company of Cuba, Mo. under Model Designation EGL2436, EGL2448 or EGL3636.

Diesel fuel from tank 20 is used to power generators (not shown) of any suitable type in shed 21, and diesel fuel or electric power from the generators is used to power crane 25, all the conveyors, binder application 30 and briquetting unit 32.

Disposed preferably along barge 11 are a series of pairs of winches, also powered by diesel fuel or electric energy. Accordingly, winches 40, 41 from a cooperative pair, winches 42, 43 form a cooperative pair, winches 44, 45 form a cooperative pair and winches 46, 47 form a cooperative pair. Operation of these winches with respective barges and fuel plant 10 operations will be described. Alternately, the winches could be disposed on the respective barges but it is preferred to have them on the plant 10.

Figure 3:
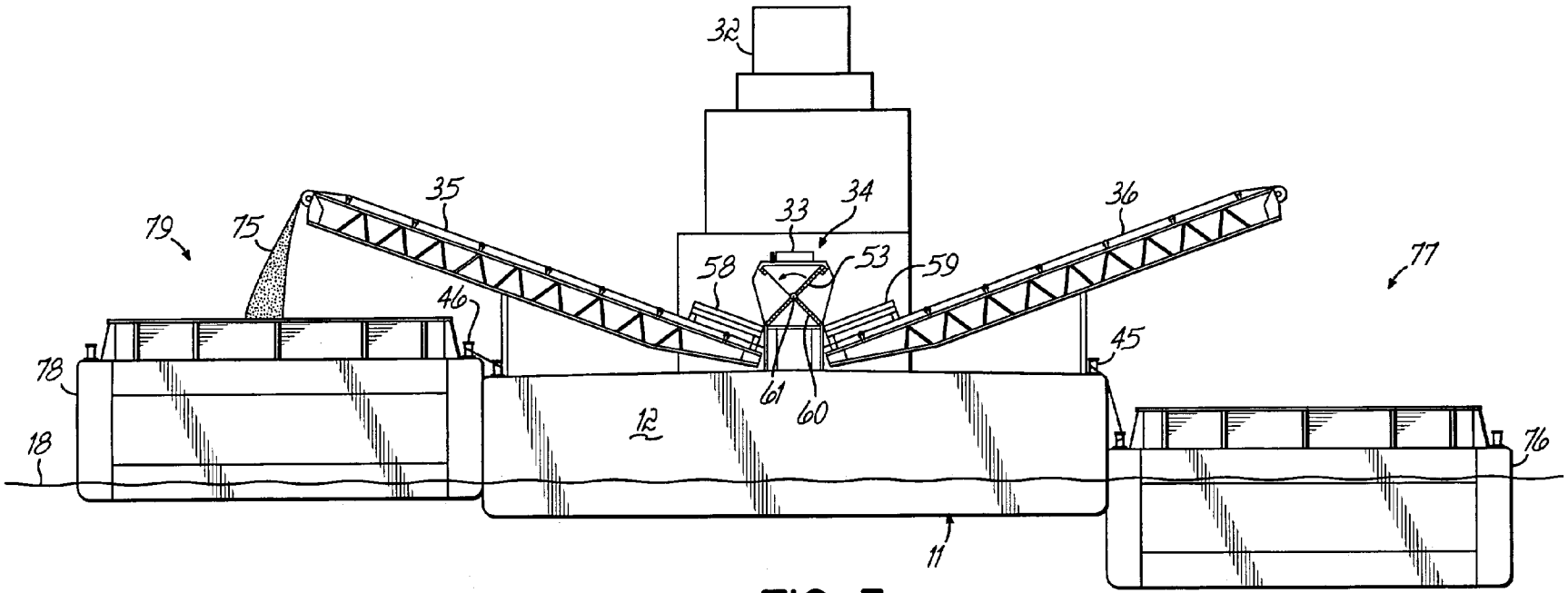
FIG. 3 is a front view of the invention of FIGS. 1 and 2 taken along lines 3—3 of FIG. 2.
Figure 3A:
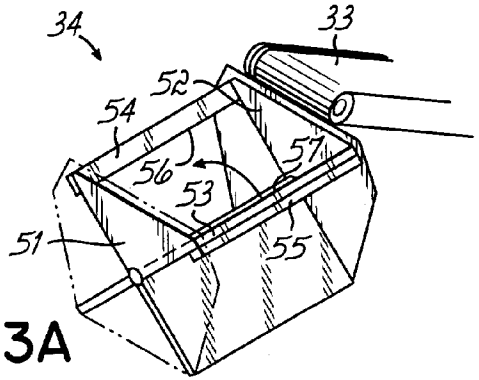
FIG. 3A is a perspective view of a synthetic fuel diverter of FIG. 3.

Turning to FIG. 3, diverter 34 is operable to direct synthetic fuel to either one or both conveyors 35, 36. Diverter 34 includes a frame having ends 51, 52, pivotable diverter plate 53 and frame members 54, 55. Diverter plate 53 is hand operated or automatically operated to close, preferably one or the other openings 56, 57 formed by respective ends 51, 52 and members 54, 55. When plate covers opening 57, synthetic fuel is diverted to conveyor 35. When plate 53 covers opening 56, synthetic fuel is diverted to conveyor 36. Hoppers 58, 59 receive fuel from diverter 34 respectively for conveyors 35, 36. Diverter 34 has a V-shaped bottom 60, with an apex proximate pivot point 61 of plate 53, to cooperatively divert synthetic fuel in the proper direction.

Alternately, the plate 53 could be centered vertically and synthetic fuel diverted by plate 53 and bottom 60 to both conveyors 35, 36 simultaneously, should that be desired.

Figure 2:
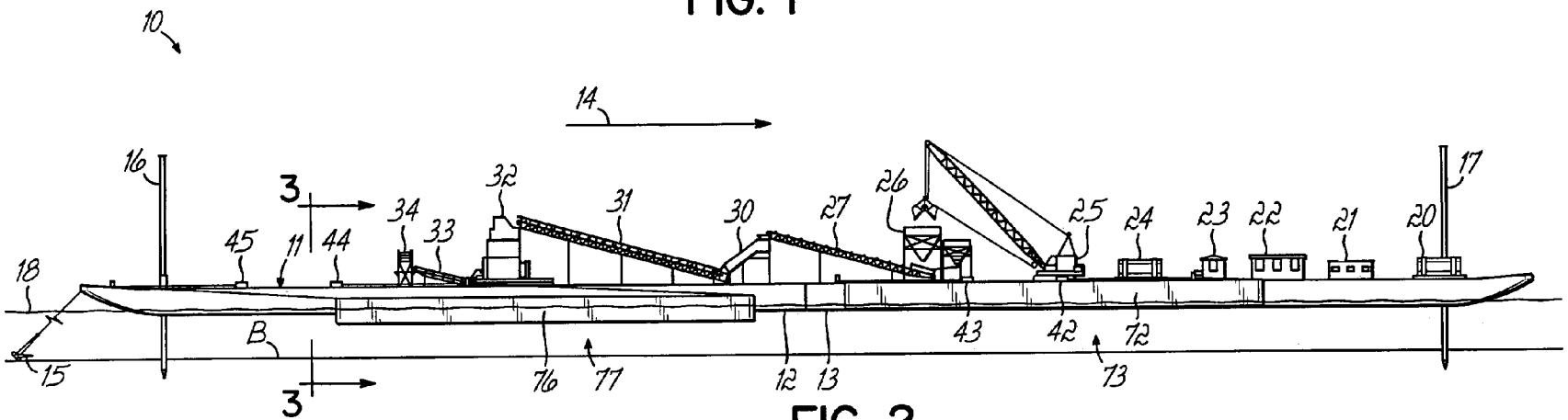
FIG. 2 is an elevational view of the invention of FIG. 1.

For purposes of description, and as viewed in the FIGS. 1 and 2, the right end of the plant 10 and its features will be referred to as the rear end or downstream end, while the lefthand end plant 10 and its features will be referred to as the front end or upstream end.

Referring to FIG. 1, there is shown a mined coal 65, delivery barge 70, at an unloading station 71, a delivery barge 72 at a cleaning station 73, a synthetic fuel 75 delivery barge 76 at a loading station 77, and a synthetic fuel delivery barge 78 and another loading station 79.

Barges 70 and 72 can be serviced or unloaded by crane 25. Barges 76, 78 are serviced or loaded respectively by conveyors 36, 35.

In operation, barge 70 is positioned at unload station 71 as shown in FIG. 1. Mined coal 65 is unloaded from barge 70 by crane 25 and delivered to hopper assembly 26 which deposits mined coal 65 on conveyor 27. Conveyor 27 delivers mined coal 65 to binder applicator 30, where the mined coal is treated with an approved liquid binder, such as latex or any other suitable binder as described above, and such as by spraying. Treated, mined coal 65*a* is conveyed from binder applicator 30 to briquetting unit 32 by conveyor 31. In briquetting unit 32, the treated mined coal 65*a* is formed into an appropriate briquet, pellet or other shape and is discharged onto conveyor 33.

From conveyor 33, the so-formed synthetic fuel 75 is delivered to diverter 34 and there directed to conveyors 35 and 36 for delivery to barges 78 or 76, respectively. Barge 76 is shown in FIG. 1 in filled condition, but it is still tethered at station 77 to plant 10. Synthetic fuel 75 is being delivered, in FIG. 1, to barge 78 at station 79.

Returning to station 71, barge 70 is positioned there, preferably by winches 40, 41, working cooperatively to hold barge 70 forwardly at first, then allowing barge 70 to move rearwardly or downstream until unloaded by crane 25, as illustrated. Alternately, a tug 82, useful for delivering barge 70 to station 71 could be used to position and allow downstream movement of barge 70 to the position shown in phantom in FIG. 1 while the barge 70 is unloaded.

After barge 70 is unloaded, the tug 82 is useful to move a barge 70 to a cleaning station 73, where another delivery barge 72 is shown. Here, if necessary, a loader vehicle can be used to clean the bottom of barge 72 (after it has been unloaded at station 71). Crane 25 can access remaining mined coal 65 in barge 72. Alternately, barge 72 may comprise another mined coal delivery barge, unloaded at station 73 by crane 25. Winches 43, 42 cooperate to move barge 72 in a desirable direction for cleaning or unloading.

From either position 71, 73, a barge 70, 72 can be moved by a tug 82, or by winches, to a loading station 77 or 79 where the unloaded barges can be filled with synthetic fuel 75 as described above. Winches 44, 45 are useful in controlling synthetic fuel delivery barge 76 from an upstream to a downstream position (shown in FIG. 1) for loading with synthetic fuel 75 by conveyor 36. Winches 46, 47 are useful to control synthetic fuel delivery barge 78 in a likewise upstream to downstream position for loading with synthetic fuel 75 by conveyor 35. Barge 76 is shown fully loaded, thus sitting deeper in the waterway than only partially-loaded barge 78 (FIG. 3).

Once loaded with synthetic fuel 75, delivery barges 76, 78 can be moved by a tug, such as tug 82, to an energy producer on a nearby bank of the waterway in which plant 10 floats, or to an energy producer in an upstream or downstream location.

It will be appreciated that all the winches, however positioned on the barges or on plant 10, are disposed effectively proximate their respective stations to control the appropriate movement of the respective barges as they are unloaded to, or loaded from, plant 10.

Also, it will be appreciated that finished synthetic fuel 75 could be delivered from floating plant 10 (such as from briquetting unit 32 or conveyor 33) to an energy consumer by pipeline, conduit or conveyor spanning from plant 10 to such energy producer located, for example, on a nearby bank of a waterway in which plant 10 floats.

It will be appreciated that both mined coal 65 and an approved liquid binder are preferably delivered by water transportation to floating plant 10. Both could be supplied by floating or supported conveyors or pipelines but the independent, floating nature of plant 10 makes possible significant and previously unknown advantages.

It will be appreciated that floating plant 10 can itself be easily moved by suitable motive means, such as one or more tugs, to any suitable location in a commercially-navigable, inland waterway to provide a source of synthetic fuel for an appropriate energy producer.

This invention effectively eliminates the necessity for any land-based, land supplied synthetic fuel plant at or on the facility of an energy producer, eliminating the environmental and traffic concerns normally associated with a land-based plant.

Also, plant 10 may be located in a waterway such that it is regulated under one state or municipal jurisdiction when the energy producer is located in another, where that is desirable.

It will be appreciated that the features of plant 10, such as tanks 20, 24, generators in shed 21 and the operative components are operatively interconnected by any suitable pumps, pipelines, conduits, wires and the like, as desired, and that floating plant 10 thus compromises a floating, moveable, self-contained, waterway supplied, synthetic fuel plant.

Finally, it will be appreciated that while certain processing steps and elements for producing synthetic fuel on barge 11 have been described in detail, any suitable synthetic fuel producing processes and equipment, comprising means for making synthetic fuel, can be used, without departing from the overall scope of the invention, comprising a floating synthetic fuel plant.

These and other advantages and modifications will be readily appreciated by those of ordinary skill in the art without departing from the scope of the invention and applicant intends to be bound only by the claims appended hereto.

What is claimed is:

1. A self-contained, floating synthetic fuel plant in an inland waterway and including:

an elongated inland barge;

apparatus for unloading non-slurry coal from a coal supply barge onto said elongated barge in an inland waterway;

apparatus on said elongated barge for applying binder to treat coal unloaded from said coal supply barge;

apparatus on said elongated barge for forming briquets of synthetic fuel comprising coal and binder; and apparatus for discharging synthetic fuel from said elongated barge onto a synthetic fuel delivery barge in an inland waterway.

2. A plant as in claim 1 further including:

apparatus for moving said coal supply barge with respect to said elongated barge as coal is unloaded from said coal supply barge.

3. A plant as in claim 1 further including:

apparatus for moving said synthetic fuel delivery barge with respect to said elongated barge as synthetic fuel is delivered onto said synthetic fuel delivery barge.

4. A plant as in claim 1 further including a binder holding tank on said elongated barge.

5. A plant as in claim 1 including a diesel fuel tank and a generator on said elongated barge for powering said apparatus for unloading, said apparatus for applying binder, said apparatus for forming briquets and said apparatus for discharging.

6. A plant as in claim 1 including a coal hopper and a conveyor for transferring coal from said hopper to said apparatus for applying binder.

7. A plant as in claim 6 including a second conveyor for transferring coal from said apparatus for applying binder to said apparatus for forming briquets.

8. A plant as in claim 7 including a third conveyor for delivering coal treated with binder to said synthetic fuel delivery barge.

9. A plant as in claim 7 wherein said barge floats in a waterway and said conveyors move coal in a direction opposite to current of said waterway.

10. Apparatus for making synthetic fuel of coal and a binder and comprising:

a self-containing floating synthetic fuel plant situated in an inland waterway;

at least one station proximate said plant for unloading coal from a coal delivery barge in an inland waterway means on said plant for manufacturing synthetic fuel; and at least one discharge station proximate said plant for discharging synthetic fuel onto a synthetic fuel delivery barge in an inland waterway.

11. Apparatus as in claim 10 wherein said plant further includes a liquid binder tank thereon.

12. Apparatus as in claim 10 wherein said plant further includes a diesel fuel tank and electricity generating means.

13. Apparatus as in claim 10 further including a crane on said plant for unloading coal from a barge and for delivering coal to a synthetic fuel manufacturing means on said plant.

14. Apparatus as in claim 10 further including winch means proximate said at least one loading station for controlling movement of a coal barge in a downstream direction as coal is unloaded from said coal delivery barge.

15. Apparatus as in claim 10 further including winch means proximate said at least one discharge station for controlling downstream movement of said synthetic fuel delivery barge as it is loaded with synthetic fuel from said plant.

* * * * *